United States Patent [19]

Fraioli

[11] Patent Number: 4,825,846

[45] Date of Patent: May 2, 1989

[54] RIBBON-TYPE, GAS-FIRED BURNER HEAD

[76] Inventor: Joseph Fraioli, 8 Seymour Pl., White Plains, N.Y. 10605

[21] Appl. No.: 147,862

[22] Filed: Jan. 25, 1988

[51] Int. Cl.[4] ..... F24C 3/02

[52] U.S. Cl. ..... 126/92 R; 126/92 AC; 431/354; 239/555

[58] Field of Search ..... 126/92 R, 92 AC, 91 A, 126/39 E, 92 C, 44, 92 A, 39 A, 38, 39 R; 431/347, 354, 348, 171, 326; 432/227, 222, 175; 239/555

[56] References Cited

U.S. PATENT DOCUMENTS

| | | | |
|---|---|---|---|
| 901,596 | 10/1908 | Detsinyi | 239/555 |
| 1,045,473 | 11/1912 | Van Zandt | 239/555 |
| 2,621,722 | 12/1952 | Abrams | 239/555 |
| 3,088,271 | 5/1963 | Smith | 239/555 |
| 3,319,693 | 5/1967 | Bryant et al. | 126/92 R |
| 3,933,146 | 1/1976 | Hastings | 126/38 |
| 4,507,083 | 3/1985 | Fraioli | 126/92 AC |
| 4,640,678 | 2/1987 | Fraioli | 431/354 |

FOREIGN PATENT DOCUMENTS

| | | | |
|---|---|---|---|
| 731089 | 6/1955 | United Kingdom | 126/92 AC |
| 805614 | 12/1958 | United Kingdom | 126/92 R |

*Primary Examiner*—James C. Yeung
*Attorney, Agent, or Firm*—Michael Ebert

[57] ABSTRACT

A ribbon-type, gas-fired burner head usable as a heat source, which head may also be combined with a refractory body to form an infrared radiation heater. The burner head includes a pair of parallel plates having a circular, oblong or other configuration having a continuous contour free of discontinuities, and a stack of continuous corrugated ribbons having the same configuration sandwiched between the peripheral margins of the plates to define an internal fuel chamber. Fed into this chamber through an inlet nipple attached to one of the plates is a mixture of pressurized combustion air and gaseous fuel in a stoichiometric ratio, the mixture being expelled from the chamber through a continuous array of minute jet openings created by the stack of ribbons. By igniting the expelled mixture, there is projected from the head a generally planar, omni-directional flame whose intensity is substantially uniform in all directions.

5 Claims, 4 Drawing Sheets

DUAL-VALVE CONTROLLER
GAS
AIR
10
11
12
13
14
15
16
16'
17
18
20
29
30

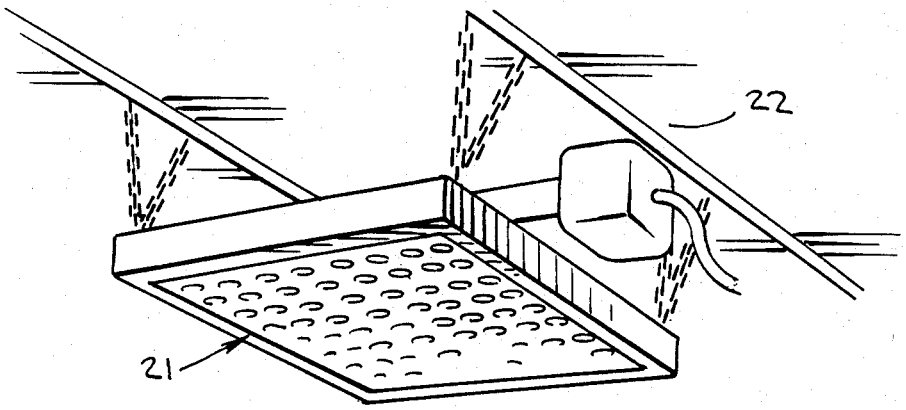
Fig. 3.
Fig. 6.
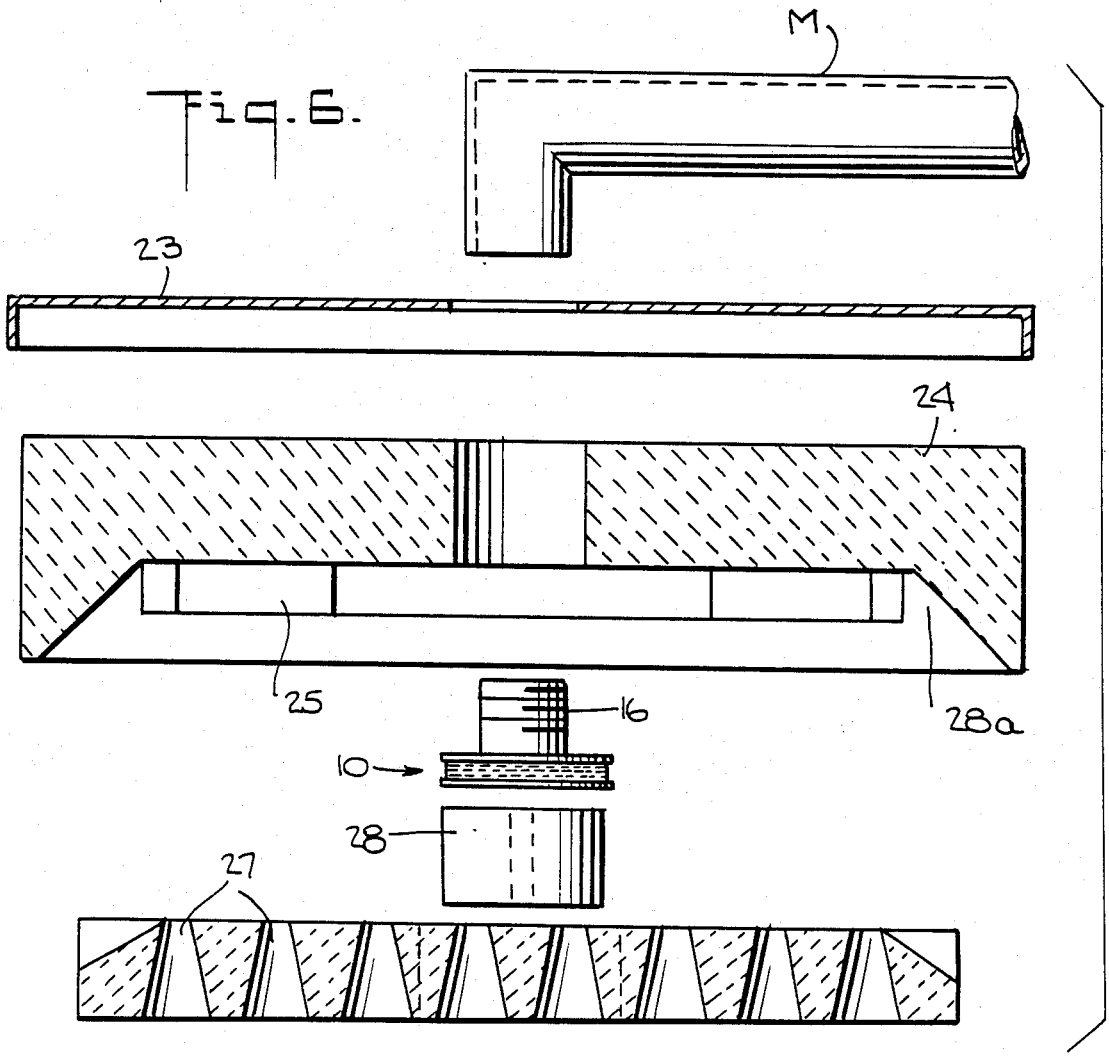

RIBBON-TYPE, GAS-FIRED BURNER HEAD

BACKGROUND OF INVENTION

1. Field of Invention

This invention relates generally to heat generators, and more particularly to a ribbon-type, gas-fired burner head which projects a generally planar, omni-directional flame whose intensity is substantially uniform in all directions, which head when combined with a refractory body forms an infrared radiation heater.

2. Status of Prior Art

The transfer of heat takes place by three processes: conduction, convection and radiation. In conduction, heat is transferred through a body by the short range interaction of molecules and/or electrons. Convection involves the transfer of heat by the combined mechanisms of fluid mixing and conduction. In radiation, electromagnetic energy is emitted toward a body and the energy incident thereto is absorbed by the body to raise its temperature. Radiant heating, therefore, differs from both convection and conduction heating, for the presence of matter is not required for the transmission of radiant energy.

According to the Stefan-Boltzmann law, the rate of heat transfer between a source of radiated heat whose temperature is $T_s$ and an absorbing body whose temperature is $T_b$ is equal to $T_s^4 - T_b^4$; that is, to the difference between the fourth powers of these temperature values. In convection heating, the rate of heat transfer is proportional only to the temperature difference between the body being heated and the surrounding atmosphere. Hence convection heating is inherently very slow, as compared to the nearly instantaneous effects of radiant heating.

An IR heater in accordance with the invention may be used throughout the full range of heating applications, including industrial processes such as industrial finishing and textile treatment, as well as in annealing, curing and drying operations which require heating.

It is known to provide infrared heaters in which a refractory body is heated by means of a ribbon-type burner to an elevated temperature causing it to emit infrared radiation. The ribbon-type burner is of the type disclosed, for example, in the Flynn U.S. Pat. No. 3,437,322, in which a gas-air-fuel mixture is fed into a cylinder having a longitudinal slot therein occupied by a stack of corrugated ribbons to create an array of minute jet openings through which the gas-air mixture is expelled. Because of the myriad of jet openings, the projected flame is not composed of discrete jets but assumes a sheet-like form.

However, the intensity of the flame is not uniform throughout the length of the ribbon, for the pressure of the gas-air mixture in the cylinder is not equalized throughout its length. Hence, the resultant infrared radiation pattern is not of uniform intensity; and when food is subjected to this pattern, the heating thereof may be uneven.

In order to overcome this problem, my prior U.S. Pat. No. 4,507,083 (1985) discloses an infrared heater for projecting an infrared beam in a radiation pattern having a predetermined geometry for irradiating the surface of a food product or other body to effect uniform heating thereof at a rapid rate. The heater includes a ribbon-type, gas-fired burner having an elongated pre-mix casing into which is fed air and gas, and an outlet extending along a slot in the casing and projecting therefrom. The outlet is provided with two sets of corrugated ribbons separated by a gas pressure chamber, whereby the air-gas mixture from the casing passes through one set into the chamber where the pressure thereof is equalized before the mixture passes through the other set from which it emerges as a sheet of flame of uniform intensity. The outlet is inserted in the longitudinal socet of a refractory body to impinge on a surface thereof whereby the surface is heated to a temperature level causing the surface to emit infrared energy which is projected by an array of radiation horns formed in the assembly.

In the ribbon-gas-fired burner disclosed in my prior U.S. Pat. No. 4,507,083 (1985), as well as in my prior U.S. Pat. Nos. 4,432,727 (1984) and 4,702,693 (1987), the burner takes the form of an elongated air-gas mixture chamber having a longitudinally-extending outlet occupied by a stack of corrugated ribbons. The difficulty experienced with this arrangement arises from the fact that one end of the elongated chamber or pipe is closed, the other end communicating with an inlet into which is fed pressurized combustion air and a gaseous fuel.

As a consequence of this arrangement, the pressurized air-gas mixture fed into the open end of the chamber travels through the chamber to impinge on the closed end thereof and is reflected thereby in countercurrent relation to the incoming mixture, thereby creating internal turbulence within the chamber which results in pressure variations along the length of the chamber.

Hence when the mixture emitted from the myriad of jet openings created by the ribbon stack is ignited, the sheet of flame emerging from the jet openings is not of uniform intensity along its length. When this gas-fired burner is combined with a refractory body to generate infrared radiation in a predetermined radiation pattern, the radiation intensity is not uniform throughout the IR radiation pattern; and when this IR heater is used to heat food or other objects irradiated by the heater, the heating is uneven.

SUMMARY OF INVENTION

In view of the foregoing, the main object of this invention is to provide a ribbon-type, gas-fired burner head which produces a generally planar, omni-directional flame whose intensity is substantially uniform in all directions.

More particularly, an object of this invention is to provide a burner of the above type which is combinable with a refractory body to create an IR heater producing a radiation pattern of substantially uniform intensity.

Also an object of this invention is to provide a ribbon-type, gas-fired burner head useful as a heat source for stoves, ovens, boilers and in other practical applications requiring an efficient heat source.

Still another object of the invention is to provide a ribbon-type, gas-fired burner which can be manufactured at relatively low cost.

Briefly stated, these objects are attained in a ribbon-type, gas-fired burner head usable as a heat source, which head may also be combined with a refractory body to form an infrared radiation heater. The burner head includes a pair of parallel plates having a circular, oblong or other configuration having a continuous contour free of discontinuities, and a stack of continuous corrugated ribbons having the same configuration sandwiched between the peripheral margins of the plates to define an internal fuel chamber. Fed into this chamber through an inlet nipple attached to one of the plates is a mixture of pressurized combustion air and gaseous fuel in a stoichiometric ratio, the mixture being expelled from the chamber through a continuous array of minute jet openings created by the stack of ribbons. By igniting the expelled mixture, there is projected from the head a generally planar, omni-directional flame whose intensity is substantially uniform in all directions.

BRIEF DESCRIPTION OF DRAWINGS

For a better understanding of the invention as well as other objects and further features thereof, reference is made to the following detailed description to be read in conjunction with the accompanying drawings, wherein:

FIG. 3 illustrates, in perspective, an infrared radiation heater in which the burner head shown in FIG. 1 is combined with a two-piece refractory body having a rectangular array of radiation horns;

FIG. 6 is an exploded view of the IR heater;

DETAILED DESCRIPTION OF INVENTION

Gas-Fired Burner Head (1st Embodiment)

Figures 1, 2, 7:
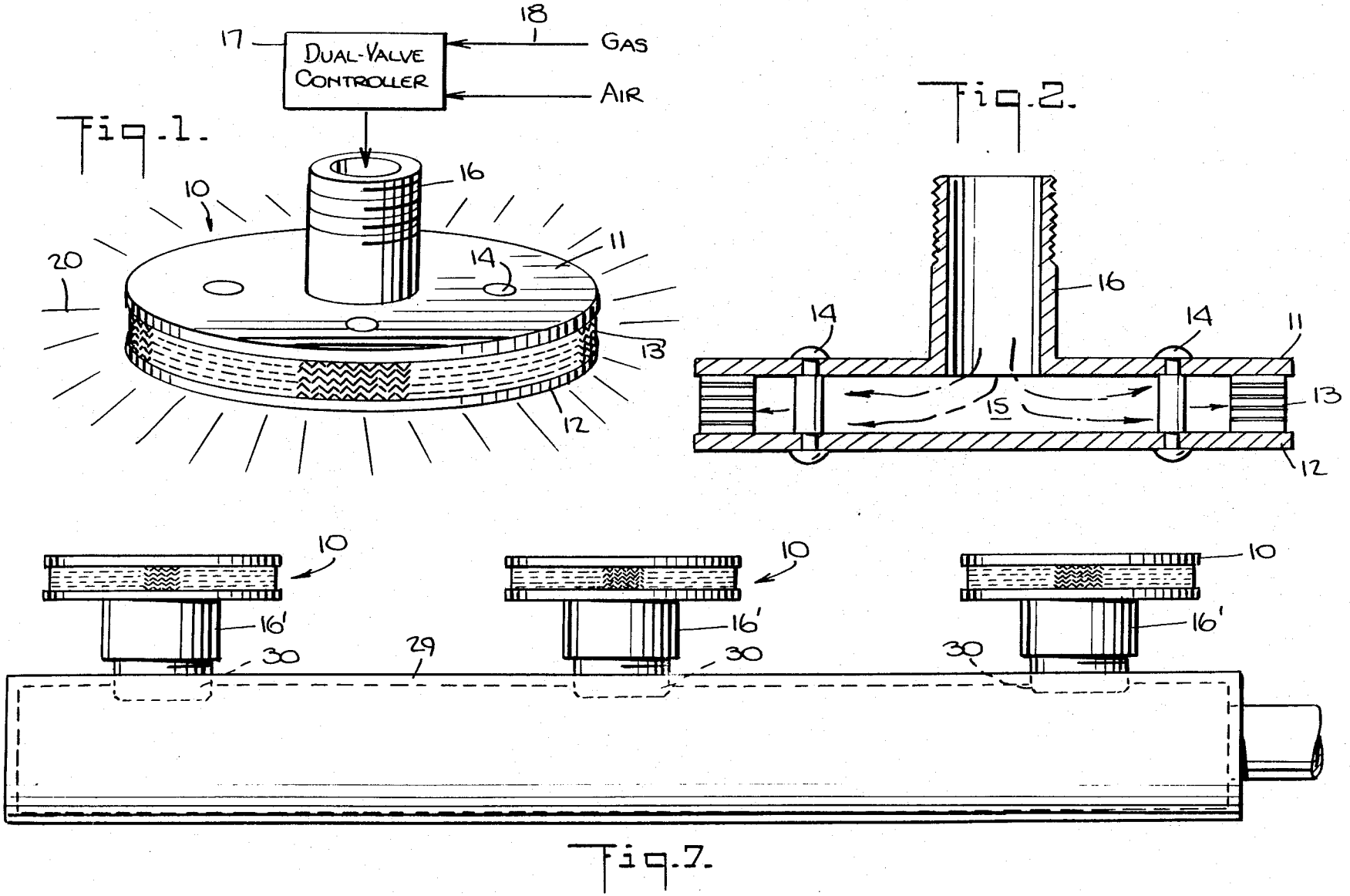
FIG. 1 is a perspective view of one embodiment of a ribbon-type, gas-fired burner head in accordance with the invention.
FIG. 2 is a diametrical section taken through the burner head.
FIG. 7 illustrates, in an elevational view, a multihead heater, each head of which is of the type shown in FIG. 1.

Referring now to FIGS. 1 and 2, there is illustrated a first preferred embodiment of a ribbon-type, gas-fired burner head, generally designated by numeral 10. Head 10 includes a pair of metal plates 11 and 12 in parallel relation having a circular configuration. Hence the circular plates have a continuous or endless contour free of sharp corners or other discontinuities. In practice, the plates may be fabricated of cast iron, stainless steel or other corrosion-resistant material of high strength.

A stack 13 of continuous corrugated ribbons having the same contour as the plates is sandwiched between the peripheral margins of the plates which are held together by rivets 14. The parallel plates which are peripherally enclosed by ribbon stack 13 define a shallow fuel chamber 15. Since the plates have a circular contour and the ribbon stack has the same contour, the stack in this embodiment of the burner has a ring shape.

Welded or otherwise attached to the central zone of plate 11 and communicating with fuel chamber 15 is a nipple 16 of the same metal which serves as an inlet to the fuel chamber. Nipple 16 is coupled by suitable piping to the output of an air-gas controller 17 which preferably is of the dual-valve type disclosed in my prior U.S. Pat. No. 4,640,678. Controller 17 is supplied both with pressurized gas through an input line 18 and with pressurized combustion air through a line 19 coming from the output of an air blower or other suitable source.

Controller 17 is adapted to mix the incoming air and gas to produce a combustible fuel air-gas mixture and to vary the flow rate thereof without, however, altering a predetermined air/gas ratio. This ratio is preferably a stoichiometric ratio resulting in complete combustion. Thus in the case of methane gas, this ratio is 64 grams of oxygen to 16 grams of methane. However, since every chemical reaction has its characteristic proportions, the ratio for optimum efficiency will depend on the gaseous fuel that is used. Because the stoichiometric ratio is maintained regardless of the flow rate setting of the controller, it becomes possible to operate the burner head at optimum efficiency throughout a broad range extending from a minimum, very-low heat intensity, to a maximum, very-high heat intensity.

The pressurized fuel fed by controller 17 into fuel chamber 15 is discharged from this chamber through the array of minute jet openings created by the stack 13 of corrugated ribbons. By igniting the expelled fuel, there is projected from the head a generally planar flame 20. Because the array of jet openings has a circular geometry, flame 20 is omni-directional. And because the gas pressure within fuel chamber 15 is substantially uniform throughout the chamber and the impedance offered to the discharge of the fuel by the ring of corrugated ribbons in stack 13 is substantially uniform in all directions, the intensity of the projected flame is substantially uniform in all directions.

Because the gaseous fuel is expelled from the continuous periphery of the burner in all directions without any interruption, it becomes possible to ignite the fuel with a single spark gap igniter placed in the proximity of the burner head. In prior ribbon-type, gas-fired burners in which gaseous fuel is expelled from opposite sides of a burner or in other prior arrangements in which interruptions exist between two or more sheets of flames projected from the burner, it is necessary to provide a separate igniter for each flame.

And since the burner head in accordance with the invention produces an omni-directional flame of substantially uniform intensity in all directions, for automatic control purposes, all that is required is a single thermal sensor in the proximity of the burner head to produce a signal whose magnitude depends on the flame intensity. This signal is compared in an electronic controller with an adjustable set point to maintain the flame intensity at a desired setting in a given range. Thus a burner head having a continuous geometry simplifies the ignition and the other controls associated with a gas-fired burner head.

The IR Heater:

A ribbon-type, gas-fired burner head in accordance with the invention has many practical applications, such as in stoves, ovens, broilers and other forms of apparatus which require a gas-fired heat source. Because it produces an omni-directional flame of substantially uniform intensity, it has distinct advantages over conventional types of burner heads.

The same heater head may also be combined, as shown in FIG. 3, with a refractory body having an array of radiation horns, to form an infrared heater 21 which radiates infrared energy in a radiation pattern determined by the design of the refractory body. In the unit shown in FIG. 3, the unit is mounted just below the ceiling 22 of an industrial plant or work place to heat the interior thereof.

Figure 4:
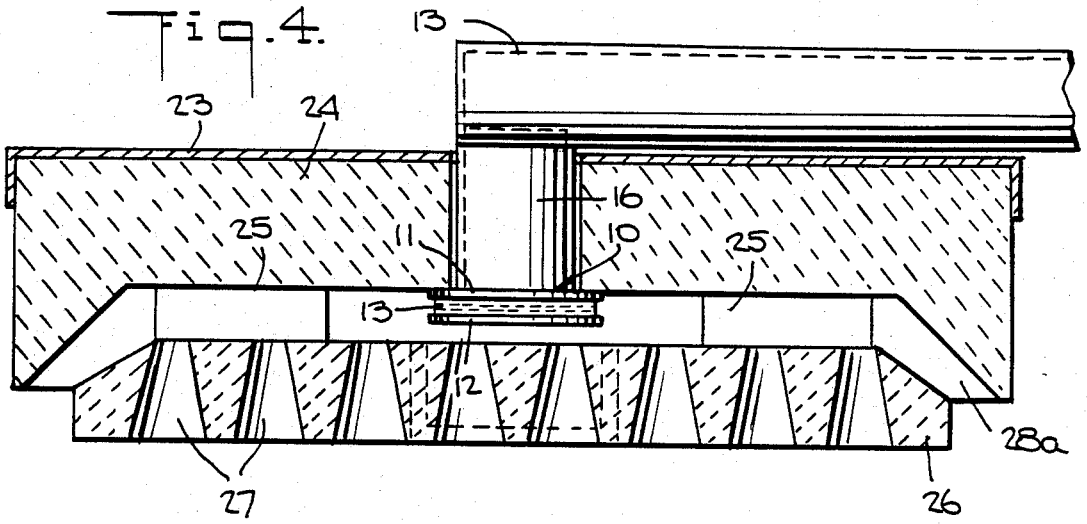
FIG. 4 is a section taken through the IR heater shown in FIG. 3.
Figure 5:
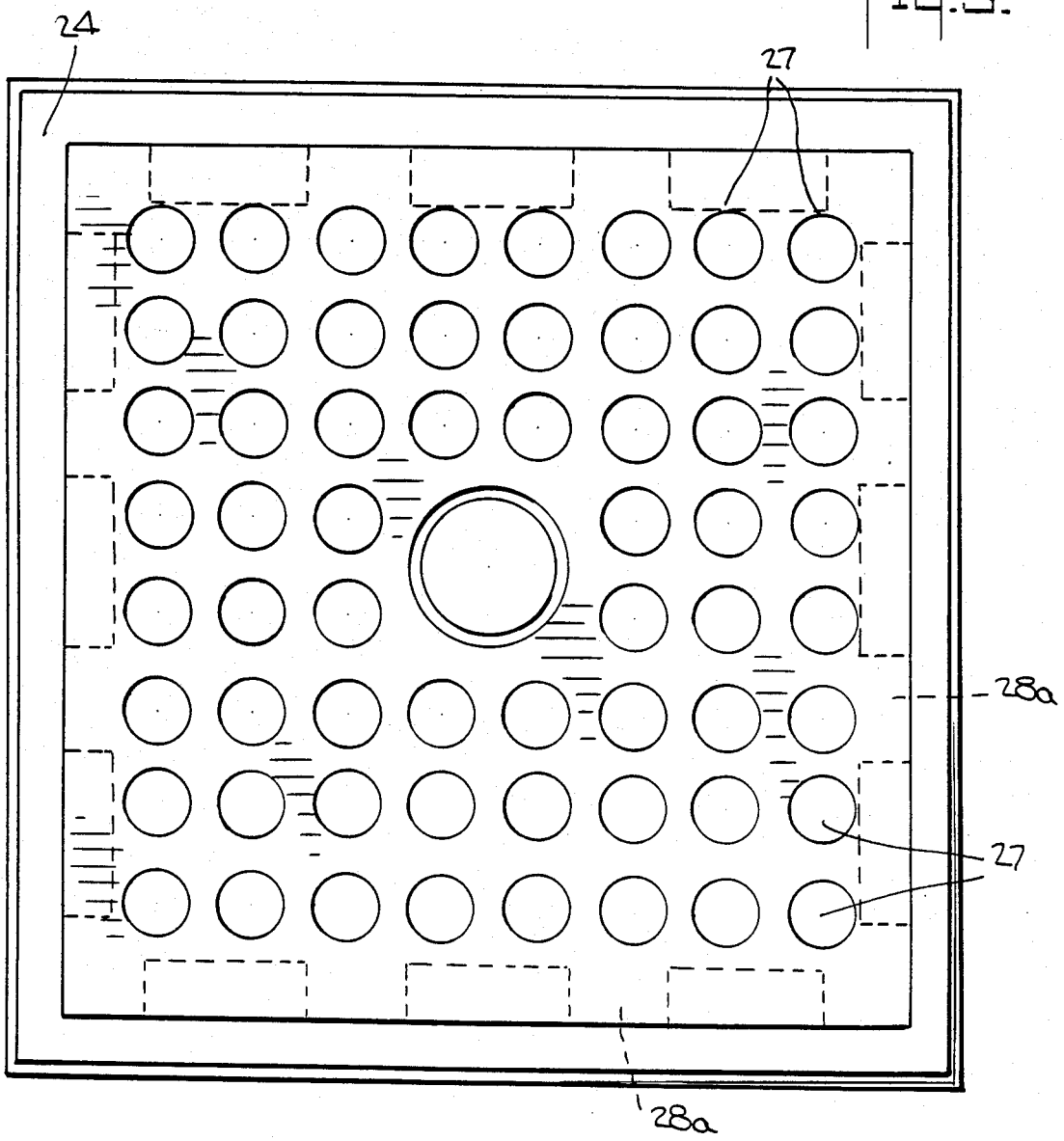
FIG. 5 is a plan view of the IR heater.

As illustrated in FIGS. 4, 5 and 6, the IF heater unit includes a rectangular mounting platen 23 in which is nested a refractory block 24 having a cavity 25 therein functioning as a combustion chamber. Joined to block 24 is a face block 26 of the same refractory material provided with a rectangular array of conical openings 27 functioning as radiation lenses or horns.

Each block is composed of refractory material, a preferred material for this purpose being "Cera Form," a refractory produced by Johns-Manville, of Denver, Colo., made from a wet slurry formulation that includes refractory fibers and multi-component binder systems. Thus "Cera Form" type 103 includes Alumina (39.6%) and Silica (50.7%). Because the material can be molded, it can be made into the special shapes called for in the present application. In practice, however, the refractory body may be molded in integral form rather than being made up of individual blocks or modules. While a fibrous refractory body has been disclosed, the infrared emitting material may be of ceramic or any other suitable composition.

The nipple 16 of the gas-fired burner head 10 is received within a central bore that goes through platen 23 and refractory body 24, head 10 being placed within combustion chamber 25 so that its flame is projected omni-directionally to impinge on the side wall of the combustion chamber. The gaseous fuel is supplied to the inlet nipple 16 of the burner head through a manifold M. Fitted within a central bore in the face block 26 is a circular cap 28 of refractory material that lies against plate 12 of the head. Thus the head is concealed and shielded within the refractory body.

The flame impinging on the wall surface of combustion chamber 25 produces a high density flux of maximum radiance. The flame is not the source of infrared radiation, for its function is to heat the surface of the refractory to a temperature level (i.e., 1800° to 2200° F.) at which the refractory then emits infrared energy in the micron range to effect the desired heating of the product subjected to the IR radiation pattern.

As the temperature of the refractory surface is increased, the maximum IR radiation occurs at shorter wavelengths and has a much higher intensity, with an increasingly greater portion of the radiation occurring nearer the visible range in the electromagnetic spectrum. Infrared rays travel in a straight line until they strike an absorbing surface; hence radiant heat follows the same physical laws as light waves and travels at the same speed.

The array of radiation horns 27 in the face block 26 has side walls which converge toward chamber 25. Hence the infrared radiation emitted from the surfaces of the chamber is projected through the horns to provide a radiation pattern which depends on the geometry of the horns.

In order to provide a radiation pattern for industrial heating which covers a broad region, the combustion chamber refractory body 24 and the face refractory body 26 joined thereto are provided on all sides of the rectangular structure with outwardly diverging side horns or lenses 28 which act to directed infrared radiation in a diverging pattern. Hence the resultant pattern produced by the IR heater is constituted by the IR pattern created by the rectangular array of radiation horns 27 in combination with the IR pattern created by the side horns 28. Thus a single IR heater unit 21, as shown in FIG. 3, placed near the ceiling of a large industrial work place to be heated is capable of heating the entire work place or a large section thereof.

The IR heater may be scaled up or down to satisfy particular installation requirements. And because of dual-valve controller 17, it is a very simple matter for an operator to lower or raise the heating temperature.

Multiple Burner Heads

In some instances where it is necessary to provide multiple sources of heat, as in a boiler having a bank of several gas-fired burners, this may be accomplished in the manner illustrated in FIG. 7.

In this multiple burner arrangement, use is made of a fuel manifold pipe 29 provided with a row of equi-spaced, externally-threaded outlets 30 on which are received the internally-threaded inlet nipples 16' of three circular ribbon-type, gas fired burner heads 10 of the type shown in FIG. 1. Thus all three burners in this instance are concurrently controllable in the manner shown in FIG. 1.

But should it be necessary, as in a multiple burner stove, to separately control each burner head, then a separate controllable fuel input must be provided for each head.

Figure 8:
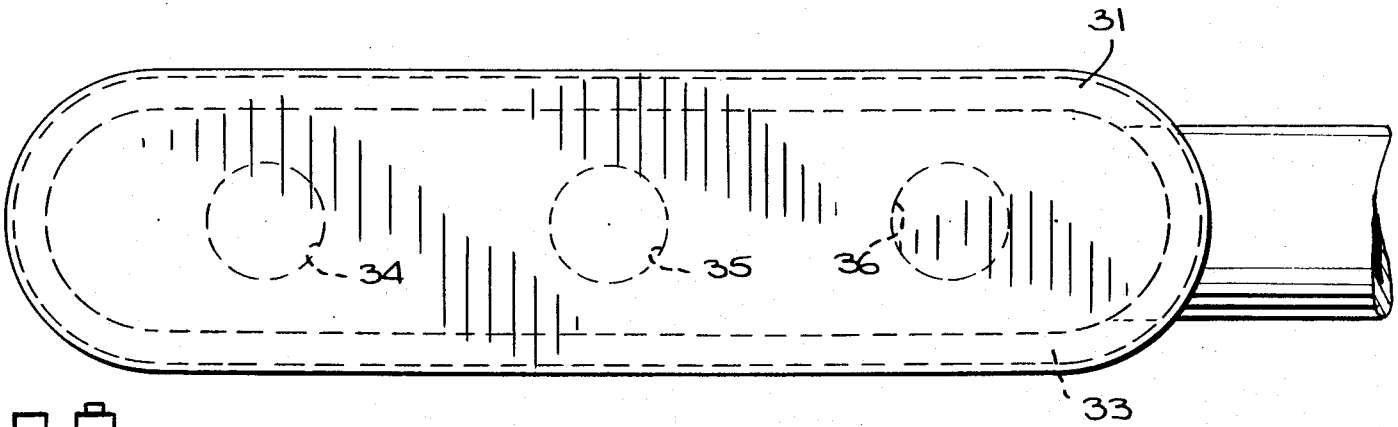
FIG. 8 shows, in plan view, another embodiment of a ribbon-type, gas-fired burner head, the head having an oblong geometry.
Figure 9:
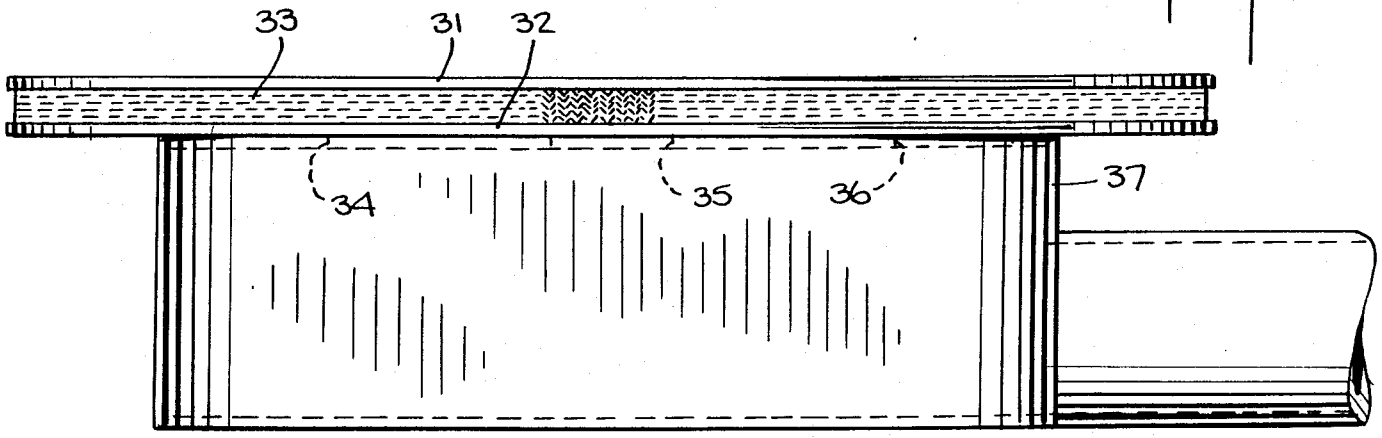
FIG. 9 is an end view of the oblong head.

Gas-Fired Burner Head (Second Embodiment):

In a circular burner head of the type shown in FIG. 1, the available heat output is limited by the circular geometry of the head; and if more heat is required from the head, one must enlarge its diameter. In some gas-fired burner applications, it is necessary to provide a large amount of heat in an elongated pattern, and for this purpose, the oblong geometry of the gas-fired burner shown in FIGS. 8 and 9 is appropriate.

In this arrangement, the burner head is composed of a pair of parallel metal plates 31 and 32 having an oblong configuration, so that the contour is again continuous or endless and free of sharp corners and other discontinuities. A stack 33 of corrugated ribbons having the same endless oblong configuration is sandwiched between the peripheral margins of the plates to define an internal fuel chamber having an oblong cross-sectional area. The chamber is supplied with a combustible air-gas mixture through three equi-spaced inlet nipples 34, 35 and 36 which are coupled to a manifold 37 into which is fed a suitable air-gas mixture from a dual controller, as in FIG. 1. In this instance, the flame is projected omni-directionally from the oblong periphery of the burner, the intensity being substantially the same in all directions.

The invention is not limited to a gas-fired burner of circular or oblong geometry, and other continuous or endless contour geometries, such as oval and elliptical geometries may be used to project a generally planar flame having the same geometry.

While there have been shown and described preferred embodiments of a ribbon-type, gas-fired burner head in accordance with the invention, it will be appreciated that many changes and modifications may be made therein without, however, departing from the essential spirit thereof.

I claim:

1. A self-sufficient ribbon-type, gas-fired heater head comprising:

A. a pair of parallel metal plates having an endless peripheral contour that is circular or oblong and is free of discontinuities, one plate having an opening therein;

B. a stack of endless corrugated ribbons having essentially the same contour sandwiched between the peripheral margins of the plates to define in the region between the plates a fuel chamber, said plates being held together by rivets extending through said region, said stack of ribbons creating a multiplicity of minute jet openings; and C. an inert nipple integral with said one plate communicating with the opening therein to feed into said chamber a pressurized, combustible, air-fuel mixture, whereby the fuel mixture is expelled through said jet openings to create, when ignited, a generally planar, omni-directional flame whose intensity is substantially uniform in all directions.

2. A heater head as set forth in claim 1, wherein said plates are fabricated of stainless steel.

3. A heater head as set forth in claim 1, in combination with a refractory body to form an infrared radiation heater, said body having a combustion chamber therein provided with a side wall and a face which chamber accommodates said head whose flame is directed to impinge on said side wall of the combustion chamber, thereby causing the body to emit infrared radiation which is emitted from the heater through an array of horns formed in the face of the body.

4. A heater head in combination with a refractory body as set forth in claim 3, wherein said body is provided with diverging side horns which, in combination with the array of horns, creates an enlarged radiation pattern.

5. A heater head in combination with a refractory body as set forth in claim 3, wherein said body is composed of a main section containing said combustion chamber and a face section joined thereto containing the array of horns.

* * * * *